US008308909B2

(12) United States Patent
Häussler et al.

(10) Patent No.: US 8,308,909 B2
(45) Date of Patent: Nov. 13, 2012

(54) SHEET FORMING SYSTEM FOR A MACHINE FOR PRODUCING A MULTILAYER FIBROUS WEB

(75) Inventors: Markus Häussler, Herbrechtingen (DE); Konstantin Fenkl, Gerstetten-Heldenfingen (DE); Wofgang Ruf, Herbrechtingen (DE); Jürgen Prössl, Horgenzell (DE); Mathias Schwaner, Ravensburg (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/161,086

(22) Filed: Jun. 15, 2011

(65) Prior Publication Data

US 2011/0303382 A1 Dec. 15, 2011

Related U.S. Application Data

(63) Continuation of application No. PCT/EP2009/063884, filed on Oct. 22, 2009.

(30) Foreign Application Priority Data

Dec. 16, 2008 (EP) ..... 08171763

(51) Int. Cl.
*D21F 1/06* (2006.01)

(52) U.S. Cl. ..... 162/343; 162/341; 162/123

(58) Field of Classification Search ..... 162/343, 162/341, 123
See application file for complete search history.

(56) References Cited

U.S. PATENT DOCUMENTS 4,812,209 A * 3/1989 Kinzler et al. ..... 162/343
4,891,100 A * 1/1990 Hildebrand ..... 162/343
4,941,950 A 7/1990 Sanford
5,545,294 A * 8/1996 Linden et al. ..... 162/343
5,645,689 A 7/1997 Ruf et al.
6,059,929 A * 5/2000 Dahl ..... 162/123
6,139,687 A * 10/2000 Beuther ..... 162/123
6,319,366 B1 * 11/2001 Mausser et al. ..... 162/343
6,372,092 B1 * 4/2002 Bubik et al. ..... 162/344
6,475,345 B2 11/2002 Mausser et al.
2001/0153113 10/2002 Ruf et al.

FOREIGN PATENT DOCUMENTS

DE 40 19 593 C2 1/1992

(Continued)

OTHER PUBLICATIONS

International Search Report for Serial No. PCT/EP2009/063884, dated Dec. 2, 2009 (4 pages).

(Continued)

*Primary Examiner* — Mark Halpern
(74) *Attorney, Agent, or Firm* — Taylor IP, P.C.

(57) ABSTRACT

A sheet-forming system includes a separating wedge with a separating wedge protrusion in a range of 0.05 to 3.0 of the largest single gap width of at least two nozzle chambers. The separating wedge includes two separating wedge areas, each having one separating wedge angle, an upstream separating wedge starting area and a downstream separating wedge ending area. The two separating wedge angles assume different angles. The separating wedge starting angle of the upstream separating wedge initial area assumes a greater angle than the separating wedge ending angle of the downstream separating wedge end area. At least one separating wedge surface is a nonplanar transitional area between the two separating wedge areas. The fibrous material suspension free jet formed from at least two fibrous material suspension streams has a free jet length of 100 to 500 mm. The forming roll has a diameter of 1,200 to 2,500 mm.

30 Claims, 3 Drawing Sheets

FOREIGN PATENT DOCUMENTS

| | | | |
|---|---|---|---|
| DE | 43 23 050 | C1 | 2/1995 |
| DE | 195 38 149 | A1 | 4/1997 |
| DE | 199 63 103 | A1 | 6/2001 |
| DE | 10 2005 003 531 | A1 | 8/2006 |
| DE | 10 2008 043 145 | A1 | 4/2010 |
| EP | 1 881 106 | A1 | 1/2008 |
| WO | 98/27270 | A1 | 6/1998 |

OTHER PUBLICATIONS

Written Opinion of the International Search Authority (dated Dec. 2, 2009) for PCT/EP2009/063884 (6 pages).

Communication dated Jan. 20, 2011 from European Patent Office for EP Application No. 08171763.9-2314 (1 page).

Communication dated May 28, 2009 from European Patent Office for EP Application No. 08171763.9-2314, including European Search Report (dated May 6, 2009) and opinion (6 pages).

International Search Report dated Jul. 1, 2011 for PCT/EP2009/063549 (2 pages).

English translation of International Preliminary Report on Patentability dated Sep. 6, 2011 for PCT/EP2009/063549 (7 pages).

English translation of Written Opinion of the International Searching Authority (undated) for PCT/EP2009/063549 (6 pages).

International Search Report dated Dec. 2, 2009 for PCT/EP2009/063884 (2 pages).

English translation of International Preliminary Report on Patentability dated Jun. 21, 2011 for PCT/EP2009/063884 (9 pages).

English translation of Written Opinion of the International Searching Authority (undated) for PCT/EP2009/063884 (8 pages).

* cited by examiner

SHEET FORMING SYSTEM FOR A MACHINE FOR PRODUCING A MULTILAYER FIBROUS WEB

CROSS REFERENCE TO RELATED APPLICATIONS

This is a continuation of PCT application No. PCT/EP2009/063884, entitled "SHEET-FORMING SYSTEM FOR A MACHINE FOR PRODUCING A MULTILAYER FIBROUS MATERIAL WEB", filed Oct. 22, 2009, which is incorporated herein by reference.

BACKGROUND OF THE INVENTION

1. Field of the Invention

The invention relates to a sheet forming system for a machine for producing a multilayer fibrous web, especially a multilayer paper or cardboard web consisting of at least two fibrous stock suspensions, including a multilayer headbox with a headbox nozzle which comprises at least two converging nozzle chambers extending over the width of the machine and separated from one another by at least one separating wedge, each carrying one fibrous stock suspension in the form of a fibrous suspension stream during operation of the multilayer headbox. Said nozzle chambers are respectively equipped with an upstream feed device and a downstream outlet gap respectively extending over the width and comprising a gap width, the two outer nozzle chambers respectively having an outside wall on their outside and the separating wedge having two separating wedge surfaces which are in contact with the respectively adjacent fibrous stock suspension streams during operation of the multilayer headbox; and one gap former which is located immediately downstream from the multilayer headbox and which has two continuous revolving wires, the first wire of which runs over a circumferential area of a forming roll and the second wire of which runs over a circumferential area of a breast roll and then runs onto the first wire in the area of the forming roll, thus forming a wedge shaped stock inlet gap which immediately receives the fibrous stock suspension streams emerging from the headbox nozzle of the multilayer headbox as one common fibrous stock suspension open jet, having a free jet length and the two wires with the at least two fibrous stock suspensions between them form a twin wire zone at least in sections.

2. Description of the Related Art

The fibrous stock suspensions are, as a rule, suspensions of different fiber stocks; they can however also be suspensions of same fiber stocks, whereby however different physical properties prevail. A physical property can for example be varying pressures for adjustment of different flow speeds in the respective fibrous stock suspension stream.

A multilayer headbox of this type for a machine to produce a multilayer fibrous web, especially a multilayer paper or cardboard web from at least two fibrous stock suspension is known for example from German disclosure document DE 195 38 149 A1. In the multilayer headbox in the embodiment of a three-layer headbox the suspension layers are kept separated by rigid separation walls. At the downstream end adjacent separation walls can be arranged differently vertical to the plane orientation of the jet so that good jet control is possible, as well as optimum combining of the suspension layers after discharge from the headbox.

Moreover, a multilayer headbox of this type is also known from the German patent document DE 43 23 050 C1. As shown in FIG. 3 of said German patent document, the disclosed multilayer headbox has a continuously tapering separating wedge for separation of two adjacent fibrous stock suspension streams in the headbox nozzle which is arranged movable by means of a linked element in upstream direction in the headbox nozzle.

In addition, a gap former of this type for a machine to produce a multilayer fibrous web, especially a multilayer paper or cardboard web from at least two fibrous stock suspensions is known for example from the German disclosure document DE 10 2005 003 531 A1. Especially FIGS. 1A through 4B respectively show a gap former whose first turning element for the first wire is a forming roll and whose second turning element for the second wire is a breast roll.

The majority of multilayer headboxes are currently employed in the packaging machinery field for the production of test liner. The increasing production speeds, as well as increasing raw material and energy costs increasingly demand the production of multilayer products with lower base weights. To this end the multilayer headboxes are operated with ever smaller gap widths or respectively fibrous stock suspension jet thicknesses. However, this increases the demands upon stability and turbulence quality of a respective fibrous stock suspension stream emerging from the headbox nozzle of the multilayer headbox for the purpose of reducing the mixing zones within the fibrous stock suspension stream in its height direction. The height direction is also referred to as "z-direction" by experts.

It is therefore the objective of the invention, and what is needed in the art is, to improve a sheet forming system of the type referred to at the beginning so that a high grade layer integrity in height direction as well as that of good optical coverage quality of the outer fibrous suspension layers is achieved in a fibrous web produced by said sheet forming system. In this context, producing a fibrous web, in particular one having a base weight in the range of 20 to 60 g/m$^2$ per fibrous suspension layer at a production speed in excess of 900 m/min. should be possible.

SUMMARY OF THE INVENTION

According to the invention this objective is met with, and the present invention provides, a sheet forming system of the type described at the beginning in that the at least one separating wedge arranged in the headbox nozzle has a separating wedge protrusion in a range of 0.5 to 3.0, preferably of 0.1 to 2.0, in particular of 0.2 to 1.5, · (times) the largest individual gap width of the at least two nozzle chambers, that the separating wedge consists of two separating wedge areas, each having a separating wedge angle, an upstream separating wedge starting area and a downstream separating wedge end area, that the two separating wedge angles of the two separating wedge areas assume different angular values, wherein the separating wedge starting angle of the upstream separating wedge starting area assumes a greater angular value than the separating wedge end angle of the downstream separating wedge end area, and that a non-planar transition area is provided between at least one separating wedge surface of the separating wedge between the two separating wedge areas of the separating wedge, that the free fibrous stock suspension jet which is composed of at least two fibrous stock suspension streams has a free jet length in the range of 100 to 500 mm, preferably 125 to 400 mm, especially 150 to 300 mm and that the open forming roll has a diameter in the range of 1,200 to 2,500 mm, preferably 1,300 to 2,400 mm, especially 1,500 to 2,200 mm.

The inventive objective is completely solved in this manner.

The thus designed headbox nozzle of the multilayer headbox of the inventive sheet forming system provides the advantage that the layer integrity in height direction can be significantly improved, compared to known multilayer headboxes. In principle this is based on that the pressure loss and thereby the fluid wall friction at the separating wedge can be decreased through shortening of the separating wedge protrusion. This is combined with a reduction of the turbulences forming in the fibrous stock suspension with associated improvement of layer integrity in height direction.

The separating wedge of the multilayer headbox of the inventive sheet forming system designed in this way also provides the advantage that layer integrity in height direction is clearly improved compared to known multilayer headboxes. The reason for this is primarily that the angle of impingement of the two fibrous suspension streams at their confluence at the separating wedge end is clearly reduced. Combined with this is a reduction of the turbulences which develop in the fibrous suspension streams, resulting in an associated improvement of the layer integrity in height direction.

The turbulences developing in the outer fibrous suspension streams also substantially influence the coverage qualities of the outer fibrous suspension layers. However, if the turbulences are reduced, then the mixing zones within the fibrous suspension jet also reduce in its height direction. These reduced mixing zones in turn contribute again substantially to the improvement of the coverage qualities of the outer fibrous stock suspension layers.

Herewith a high grade layer integrity in height direction, as well as a good optical coverage of the outer fibrous suspension layers is achieved in a fibrous web which was produced by means of the inventive multilayer headbox.

If the multilayer headbox is in the embodiment of a three- or even four-layer headbox then the separating wedge protrusions can have the same, approximately the same or even different values, depending on the application.

Generally, the individual separating wedge may consist of a special steel or similar material and in areas have a minimum rigidity in machine direction as well as in cross machine direction of a value of ≧40 N/mm. In addition the separating wedge is mounted stationary, preferably by means of an upstream separating wedge retainer, in other words not articulated, and therefore not mounted freely movable in the headbox nozzle. By definition a straight line extends in longitudinal direction, preferably centered through the upstream separating wedge retainer.

Moreover the referred to free jet length of the fibrous stock suspension free jet formed from the at least two fibrous stock suspension streams ensures a process technologically sufficient free jet quality. The fibrous stock suspension free jet does not yet experience significant spreading in the referred to longitudinal area due to the air boundary layers forming on the two free jet surfaces. By avoiding turbulences due to a non-widening of the fibrous stock suspension jet the layer integrity of the fibrous stock suspension streams in height direction can be continued.

Lastly, the open forming roll of the inventive sheet forming system with the aforementioned diameter range provides the advantage of gentle dewatering of the at least two fibrous stock suspensions located between the two wires during their common travel around a circumferential area of the open forming roll. The gentle dewatering of the at least two fibrous stock suspensions is primarily the result of the relatively large diameter of the forming roll, in combination with a sufficient guide- or respectively dewatering length on the open forming roll. Depending on the specific application the open forming roll may or may not be equipped with suction, whereby a suction equipped forming roll is well known in expert circles.

The four mentioned and inventively significant characteristics of the inventive sheet formation system ensure the continuous and process reliable achievement of a high grade layer integrity in height direction as well as good optical coverage quality of the outer fibrous suspension layers in a fibrous web produced by said system. In this context, producing a multilayer fibrous web having a base weight in the range of 20 to 60 g/m$^2$ per fibrous stock suspension layer at a production speed in excess of 900 m/min. should be possible.

A first inventive design form provides that the at least one separating wedge located in the baffle-free headbox nozzle has a separating wedge protrusion in a range of 0.05 to 1.0, preferably 0.1 to 0.95, especially 0.2 to 0.90· the largest individual gap width of the at least two nozzle chambers. In this baffle-free multilayer headbox the requirement thereby fulfilled, that no baffle protrusion due to the nonexistence of a baffle only requires a small separating wedge protrusion.

An additional inventive design form provides that on at least one outside wall of the headbox nozzle one preferably adjustable baffle with a baffle immersion depth is located and that the at least one separating wedge located in the headbox nozzle has a separating wedge protrusion in a range of 0.5 to ≦3.0, preferably 0.6 to ≦2.0, especially 0.7 to 1.5, · the largest individual gap width of the at least two nozzle chambers. This multilayer headbox hereby fulfills the requirement that a large baffle protrusion makes a larger separating wedge protrusion necessary.

In the multilayer headbox of the inventive sheet forming system a preferably adjustable baffle with a baffle immersion depth may of course also be arranged on both outside walls of the headbox nozzle. The adjustment of the baffle may for example occur by means of several regulating devices arranged over the width of the headbox, especially servomotors. This minimizes the pressure loss in the relevant fibrous stock suspension layer.

Moreover, the baffle of the multilayer headbox of the inventive sheet forming system can have a baffle immersion depth into the adjacent fibrous stock suspension stream in a range of 1 to 30 mm, preferably in a range of 5 to 15 mm. This design permits creation of a minimum turbulence in the appropriate fibrous stock suspension, without however reaching the previously described disadvantageous turbulence level.

The at least one separating wedge of the multilayer headbox of the inventive sheet forming system can have a separating wedge angle≦10°, preferably in a range between 3 and 7° so that the fibrous stock suspensions carried in the fibrous stock suspension streams experience a process technologically optimum confluence. These angle ranges moreover avoid a disadvantageous mixing of two adjacent fibrous stock suspensions.

Depending on system requirements at least one separating wedge for the separation of two adjacent fibrous stock suspension streams of the multilayer headbox of the inventive sheet forming system can moreover be arranged stationary or movably in the headbox nozzle by means of an upstream linked element. These variations permit optimum design of the multilayer headbox of the inventive sheet forming system.

The fibrous stock suspension streams emerging from the multilayer headbox of the inventive sheet forming system as a common fibrous stock suspension jet can moreover have different jet speeds. For example, the at least one difference in jet speeds may have a value in the range of 10 to 60 m/min., preferably 15 to 25 m/min. This substantially reduces the spreading of the mixture cone in the fibrous stock suspension jet to the relevant fibrous stock suspension layer. As is known, these requirements may also be dependent on the former concept.

In an additional preferred embodiment a non-planar transition area is provided respectively on both separating wedge surfaces of the separating wedge between the two separating wedge areas of the separating wedge. Thereby a clearly reduced angle of impingement of the two fibrous suspension streams can be achieved at their confluence at the separating wedge end, whereby this clearly reduced angle of impingement is then upheld by both separating wedge surfaces of the separating wedge.

Here, at least the upstream separating wedge starting area of the separating wedge can be aligned symmetrically with one straight line extending through the upstream separating wedge retainer. If in this case the downstream separating wedge end area of the separating wedge is aligned asymmetrically with a straight line extending through the upstream separating wedge retainer, then the separating wedge tip of the separating wedge is not positioned on the straight line extending through the upstream separating wedge retainer.

However, the upstream separating wedge starting area of the separating wedge, as well as the downstream separating wedge end area of the separating wedge can be aligned symmetrically with a straight line extending through the upstream separating wedge retainer, so that the separating wedge tip of the separating wedge is positioned on the straight line extending through the upstream separating wedge retainer. In this case the separating wedge is symmetric with the straight line extending through the upstream separating wedge retainer.

In an additional preferred embodiment a non-planar transition area is provided on one separating wedge surface of the separating wedge between the two separating wedge areas of the separating wedge, and a planar transition area is provided on the other separating wedge surface of the separating wedge between the two separating wedge areas of the separating wedge. The separating wedge therefore forms a planar area on one side so that the distinctly reduced angle of impingement of the two fibrous suspension streams when coming together at the separating wedge end must be supported by the other side of the separating wedge.

Here, at least the upstream separating wedge starting area of the separating wedge can be aligned symmetrically with one straight line extending through the upstream separating wedge retainer of the separating wedge. If in this case the downstream separating wedge end area of the separating wedge is aligned asymmetrically with a straight line extending through the upstream separating wedge retainer, then the separating wedge tip of the separating wedge is not positioned on the straight line extending through the upstream separating wedge retainer.

However, the upstream separating wedge starting area of the separating wedge, as well as the downstream separating wedge end area of the separating wedge can also be aligned asymmetrically to a straight line extending through the upstream separating wedge retainer of the separating wedge. In this case the separating wedge tip of the separating wedge could then be positioned on the straight line extending through the upstream separating wedge retainer of the separating wedge.

In order for the two fibrous suspensions flowing in the fibrous suspension streams to experience a process technologically optimum confluence, the separating wedge end angle of the downstream separating wedge end area has an angular value in the range of 1.5 to 8°, preferably 2.5 to 4.5°. Additionally, these angle ranges avoid disadvantageous mixing of the two adjacent fibrous suspensions. The separating wedge starting angle of the upstream separating wedge starting area preferably has an angular value in the range of 8° to 20°, preferably 10 to 15°, so that sufficient minimum rigidity of the separating wedge is provided in longitudinal direction, as well as in cross direction.

In regard to a sufficient guide length for the two fibrous suspension streams it is additionally advantageous if the downstream separating wedge end area of the separating wedge has a downstream separating wedge end length in the range of 10 to 100 mm, preferably 15 to 75 mm, especially 25 to 50 mm and/or the downstream separating wedge end area of the separating wedge protrudes beyond the outlet gap of the headbox nozzle, preferably in a range of 10 to 25 mm.

Moreover, the respective non-planar transition area at the separating wedge surface between the two separating wedge areas of the separating wedge of the multilayer headbox of the inventive sheet forming system can also be geometrically angular or round with a radius in the range of 20 to 1000 mm, preferably 100 to 500 mm, especially 150 to 250 mm.

In another embodiment the open forming roll has an open area in the range of 60 to 99%, preferably 70 to 98%, especially 80 to 96% of the total area of the forming roll, so that efficient and gentle dewatering, free or almost free of marking is possible of the at least two fibrous stock suspensions arranged between the two wires, during their common travel over one circumferential area of the open forming roll. As already mentioned, depending on the specific application the open forming roll may or may not be equipped with suction, whereby a suction equipped forming roll is well known in expert circles.

Moreover, the open forming roll preferably has an area around which both wires with the at least two fibrous suspensions between them wrap, having an angle of wrap in the range of 15 to 260°, preferably 30 to 230°, especially 50 to 180°. These areas contribute substantially to the efficient and gentle dewatering of the at least two fibrous stock suspensions between them during their common travel over a circumferential area of the open forming roll.

Also, the jet impingement of the fibrous stock suspension jet formed from the at least two fibrous stock suspension streams can be directed in a range of 0 to 100%, preferably 20 to 60% onto the open forming roll, and the at least two fibrous stock suspensions can have a respective stock consistency in the multilayer headbox of the inventive sheet forming system of 0.2 to 1.8%, preferably 0.5 to 1.6%, especially 0.7 to 1.4%.

The operational mode of the multilayer headbox of the inventive sheet forming system can occur in speed ranges of 20 to 80 m/min. or 20 to 80 m/min. respectively with exceptional water level and also with exceptionally low water levels.

Moreover, it can be advantageous in regard to regulating the fiber orientation cross profile, as well as the base weight cross profile of the multilayer fibrous web, if the multilayer headbox is equipped in another embodiment with a dilution water control of the type known from many publications. For this purpose one controlled supply stream, especially a dilution water stream is added to at least one fibrous stock suspension when producing a mixed stream with a mixed concentration.

In an additional preferred design form at least one fibrous stock suspension can be produced for the production of the multilayer fibrous web according to the following steps:

a) producing the aqueous fibrous suspension, especially from mixed waste paper;

b) cleaning of this fibrous suspension, if it contains negative contaminants.

c) fractionation of this fibrous stock suspension into a short fiber fraction with an increased number of short fibers and a long fiber fraction with an increased number of long fibers; and d) use of these fractions in the production of a fibrous web having at least one cover layer and one back side layer, especially packaging paper or cardboard.

Here, the cover layer of the multilayer fibrous web may be formed from the short fiber fraction. In addition it may be provided that the backside layer of the multilayer fibrous web is formed from the long fiber fraction.

At least one pressure sorter may be used in fractionation in which the fibrous stock suspension is fractioned with the assistance of a wet screen so that the long fiber fraction gets into the overflow and the short fiber fraction into the working cycle. For this purpose screens with slots can be used for fractionation whose slot width is 0.3 to 1 mm.

Moreover, an alternative design form provides that an at least three-layer packaging paper or an at least three-layer cardboard is produced, whereby the long fiber fraction forms the center layer of the multilayer fibrous web, and whereby the short fiber fraction forms the cover layer and the backside layer of the multilayer fibrous web. Or, an at least three-layer packaging paper or an at least three-layer cardboard could be produced whereby the long fiber fraction provides the center layer and the backside layer of the multilayer fibrous web.

The inventive sheet forming system is especially suitable for use in a machine for the production of a multilayer fibrous web, especially a multilayer paper or cardboard web consisting of at least two fibrous suspensions. In an application of this type the aforementioned advantages are achieved.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
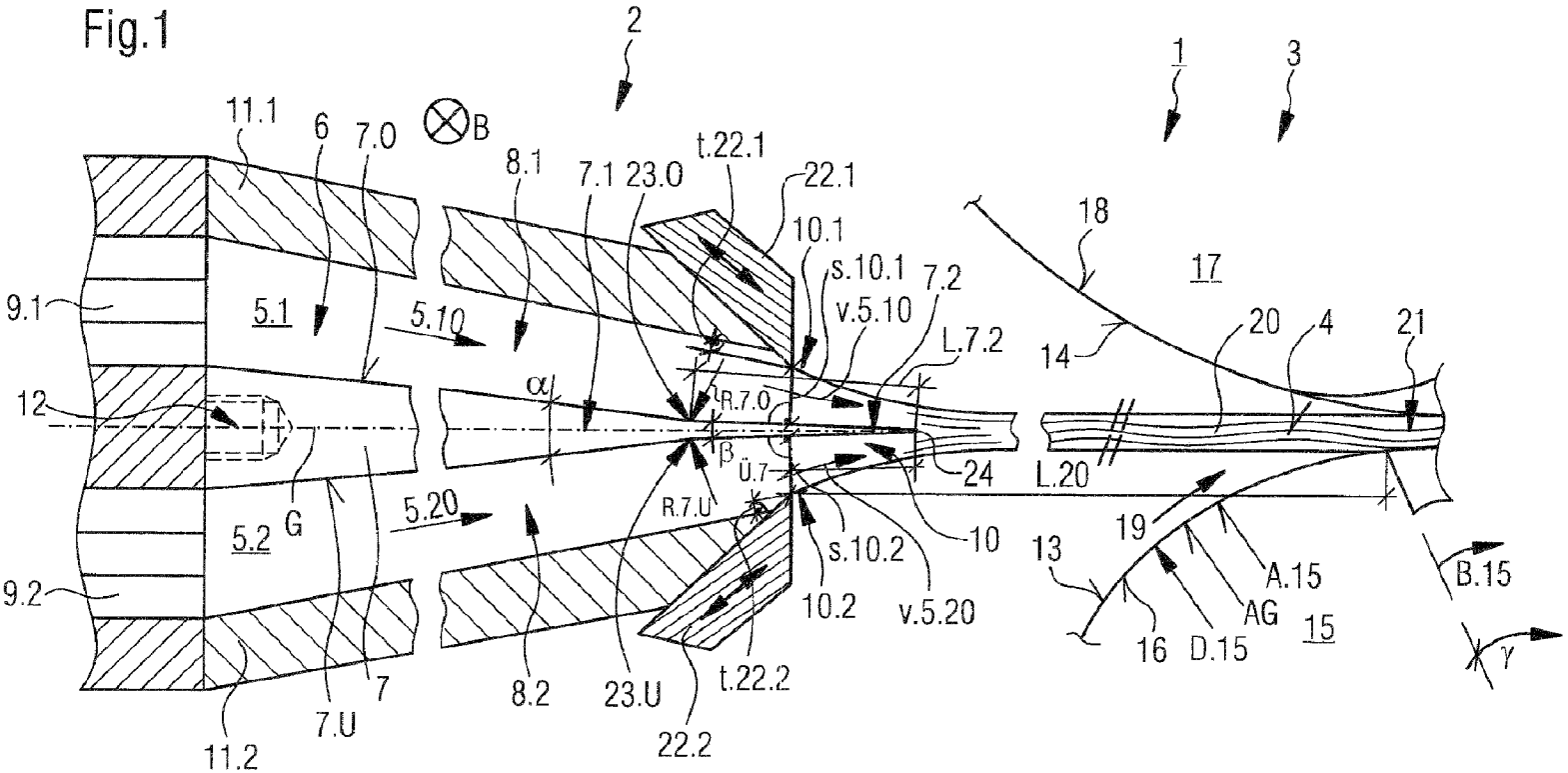
FIG. 1 is a schematic longitudinal section of one design form of a headbox nozzle in an inventive sheet forming system.

FIG. 1 illustrates a schematic longitudinal sectional view of one design form of a sheet forming system 1, comprising a multilayer headbox 2 in the embodiment of a double-layer headbox and a gap former 3. The illustrated sheet forming system 1 is part of a machine which is not depicted in closer detail, for the production of a multilayer fibrous web, in particular a multilayer paper or cardboard web consisting of two fibrous suspensions 5.1, 5.2.

Fibrous suspensions 5.1, 5.2 will generally be suspensions consisting of different fiber stocks; they could however be also suspensions of the same fiber stock, whereby however different physical properties exist.

Multilayer headbox 2 in the embodiment of a double-layer headbox includes one headbox nozzle 6 which comprises two converging nozzle chambers 8.1, 8.2 extending across the width B (arrow) and separated from each other on the inside by a separating wedge 7, guiding one respective fibrous stock suspension 5.1, 5.2 in the form of a fibrous suspension stream 5.10 (arrow), 5.20 (arrow) during operation of multilayer headbox 2. The two nozzle chambers 8.1, 8.2 have the same or approximately the same cross sectional progression. In addition each of said nozzle chambers 8.1, 8.2 comprises an upstream feed device 9.1, 9.2 which is not illustrated in further detail, a downstream outlet gap 10.1, 10.2 with a gap width s10.1, s10.2, said gap extending across the width B (arrow) and an outer wall 11.1, 11.2 respectively on the outside. Separating wedge 7 has two separating wedge surfaces 7.0, 7.0 which, during operation of multilayer headbox 2 are in contact with the respectively adjacent fibrous stock suspension stream 5.10 (arrow), 5.20 (arrow).

Gap widths s10.1, s10.2 of outlet gap 10.1, 10.2 are of the same size in the illustrated example; they can however also be of a different size. In the illustrated example the respective feed device 9.1, 9.2 which is not illustrated in detail is a turbulence generator located immediately prior to headbox nozzle 6; it may however also be located indirectly before headbox nozzle 6 and/or it may include a preferably machine wide intermediate chamber or a tubular grating. These devices are known by the expert.

Separating wedge 7 consists of a special steel or similar material and has a minimum rigidity S in longitudinal as well as in cross direction of a value of at least ≧40 N/mm. In addition separating wedge 7 in the present example is mounted rigidly by means of an upstream separating wedge retainer 12; in other words it is not articulated and therefore not mounted movable in headbox nozzle 6. By definition a straight line G extends in longitudinal direction, preferably centered through the upstream separating wedge retainer 12 of separating wedge 7.

Arranged immediately downstream from multilayer headbox 2 is gap former 3 with two revolving endless wires 13, 14. The first wire 13 runs over a circumferential area 16 of an open forming roll 15, which is only indicated here and not illustrated to scale. The second wire 14 runs over a circumferential area 18 of a breast roll 17 which is only indicated here and not illustrated to scale, before it then runs in the area of open forming roll 15 onto first wire 13, thus forming a wedge shaped stock inlet gap 19 which immediately accepts the fibrous stock suspension streams 5.10 (arrow, 5.20 (arrow) which emerge with a free jet length L.20 from headbox nozzle 6 of multilayer headbox 2 as a common fibrous stock suspension free jet 20. Subsequently both wires 13, 14 with the two fibrous stock suspensions 5.1, 5.2 between them form a twin wire zone 21, at least over sections.

Fibrous stock suspension streams 5.10 (arrow), 5.20 (arrow) emerging from multilayer headbox 6 as a common fibrous stock suspension jet 20 can have different jet speeds v.5.10 (arrow), v.5.20 (arrow). Hereby the difference in jet speeds v.5.10 (arrow), v.5.20 (arrow) assumes a value in particular in the range of 10 to 60 m/min., preferably 15 to 25 m/min.

The at least one separating wedge 7 arranged in headbox nozzle 6 has a separating wedge protrusion Ü.7 in a range of 0.05 to 3.0, preferably 0.1 to 2.0, in particular 0.2 to 1.5, · the largest individual gap width s.10.1 of the at least two nozzle chambers 8.1, 8.2.

On multilayer headbox 2 illustrated in FIG. 1, a preferably adjustable baffle 22.1, 22.2 with a baffle immersion depth t.22.1 t.22.2 is arranged on both outside walls 11.1, 11.2 of headbox nozzle 6. The respective baffle immersion depth t.22.1, t.22.2 into the adjacent fibrous stock suspension stream 5.10 (arrow), 5.20 (arrow) assumes hereby a value in a range of 1 to 30 mm, preferably in a range of 5 to 15 mm. Per definition, the respective baffle immersion depth t.22.1, t.22.2 is hereby the vertical immersion depth of respective baffle 22.1, 22.2 into the associated fibrous stock suspension stream 5.10 (arrow), 5.20 (arrow). The adjustability of respective baffle 22.1, 22.2 is indicated by a respective double arrow.

In this design form the separating wedge 7 now has a separating wedge protrusion Ü.7 in a range of 0.5 to ≦3.0, preferably of 0.6 to ≦2.0, in particular of 0.7 to 1.5· the largest individual gap width s.10.1 of the two nozzle chambers 8.1, 8.2. The separating wedge protrusion Ü.7 of separating wedge 7 preferably assumes a value in a range of 10 to 25 mm.

Moreover, separating wedge 7 consists of two separating wedge areas having a respective separation angle α, β, an upstream separating wedge starting area 7.1 and a downstream separating wedge end area 7.2. The two separating wedge angles α, β of the two separating wedge areas 7.1, 7.2 assume different angular values, whereby separating wedge starting angle α of the upstream separating wedge starting area 7.1 assumes a greater angular value than separating wedge end angle β of downstream separating wedge end area 7.2. In addition a non-planar transition area 23.0 is provided between the two separating wedge areas 7.1, 7.2 of separating wedge 7, between at least one separating wedge surface 7.0 of separating wedge 7. Also, upstream separating wedge starting area 7.1 of separating wedge 7 as well as downstream separating wedge end area 7.2 of separating wedge 7 is aligned symmetrically with a straight line G extending through the upstream separating wedge retainer 12 of separating wedge 7, so that separating wedge tip 24 of separating wedge 7 is positioned on straight line G extending through the upstream separating wedge retainer 12 of separating wedge 7.

In addition, separating wedge starting angle α of upstream separating wedge starting area 7.1 has an angular value in the range of 8 to 20°, preferably 10 to 15°. In contrast, separating wedge end angle β of downstream separating wedge end area 7.2 has an angular value in the range of 1.5 to 8°, preferably 2.5 to 4.5°, so that it is smaller than separating wedge starting angle α of upstream separating wedge starting area 7.1.

Downstream separating wedge end area 7.2 of separating wedge 7 has a downstream separating wedge end length L7.2 in the range of 10 to 100 mm, preferably 15 to 75 mm, especially 25 to 50 mm. The respective non-planar transition area 23.0, 23.0 on the appropriate separating wedge surface 7.0, 7.0 between the two separating wedge areas 7.1, 7.2 of separating wedge 7 is round with a radius R7.0, R7.0 in the range of 20 to 1000 mm, preferably 100 to 500 mm, especially 150 to 250 mm. The single non-planar transition area at the separating wedge surface between the two separating wedge areas of the separating wedge could also be geometrically angular (compare FIGS. 5 and 6).

Moreover the free fibrous stock suspension jet 20 which is composed of two fibrous stock suspension streams 5.10 (arrow), 5.20 (arrow) has a free jet length L.20 in the range of 100 to 500 mm, preferably 125 to 400 mm, especially 150 to 300 mm. Open forming roll 15 which is only indicated here and not shown to scale has a diameter in the range of 1,200 to 2,500 mm, preferably 1,300 to 2,400 mm, especially 1,500 to 2,200 mm.

Open forming roll 15 has an open area A.15 in the range of 60 to 99%, preferably 70 to 98%, especially 80 to 96% of total area AG of forming roll 15. Moreover, open forming roll 15 has an area B.15 around which both wires 13, 14 with the fibrous suspensions 5.1, 5.2 between them wrap with an angle of wrap γ in the range of 15 to 260°, preferably 30 to 230°, in particular 50 to 180°. The definition and appearance of wrap-around area B.15 of forming roll 15, as well as the angle of wrap γ of forming roll 15 are well known to the expert.

Figure 2:
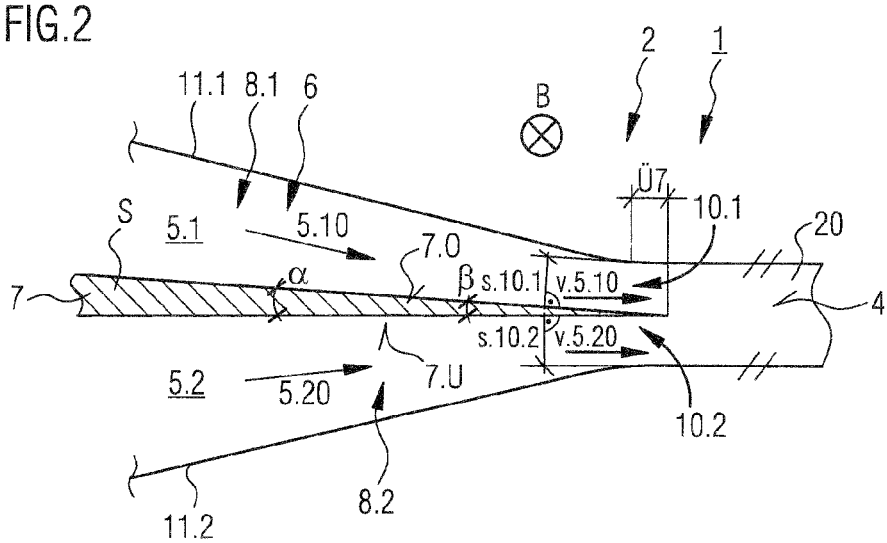
FIGS. 2-4 are schematic longitudinal sections of end areas of various design forms of a respective headbox nozzle of a multilayer headbox of an inventive sheet forming system.
Figure 3:
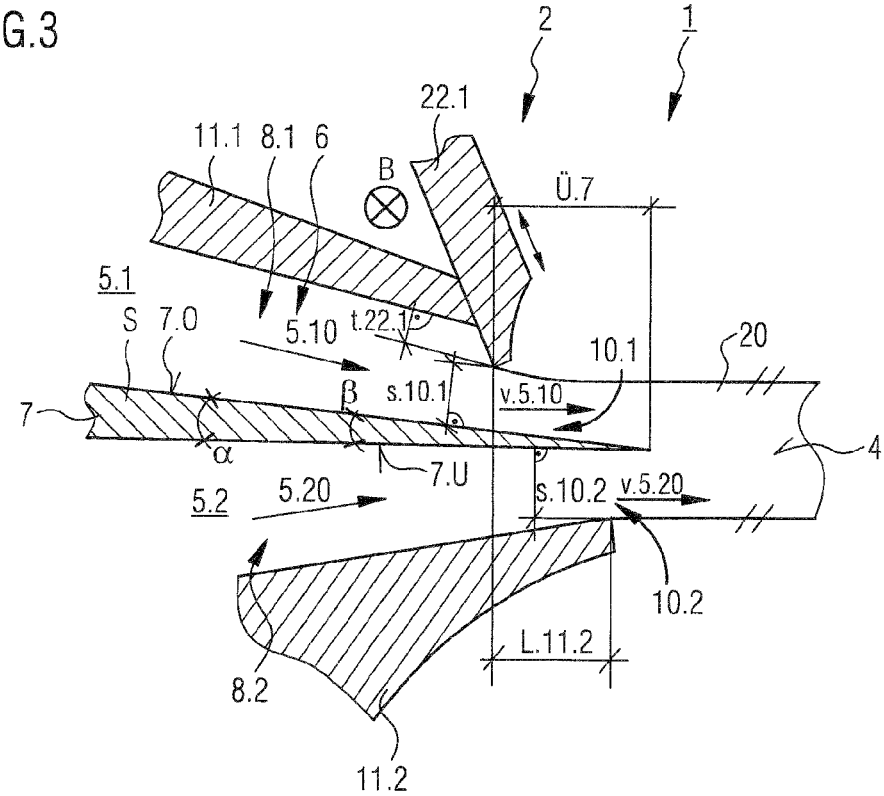
Figure 4:
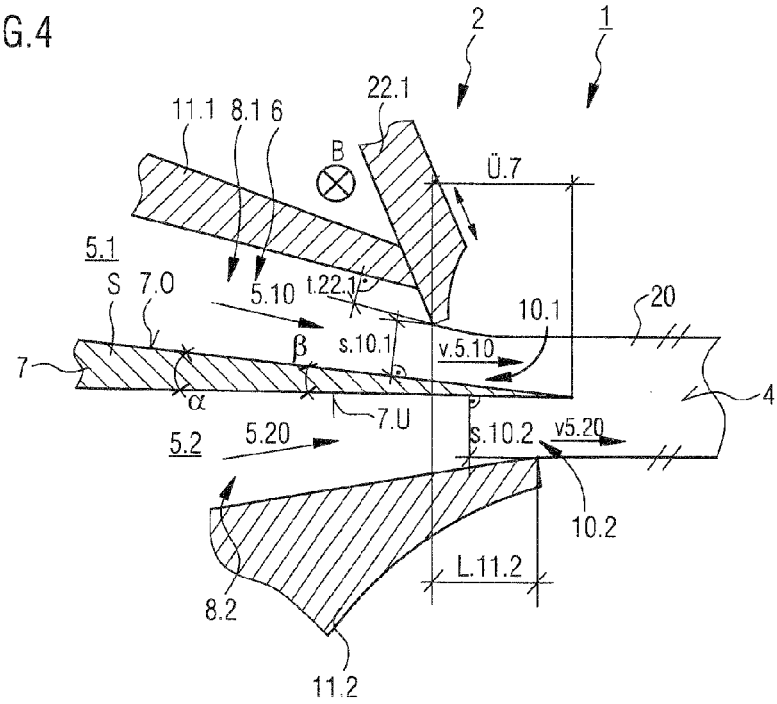

FIGS. 2 through 4 schematically illustrate longitudinal sections of end areas of three different design forms of a respective headbox nozzle 6 of a multilayer headbox 2 of an inventive sheet forming system 1. The respective basic construction of these headbox nozzles 6 is essentially consistent with the basic construction of headbox nozzle 6 illustrated schematically in FIG. 1, so that we refer to said Fig. description.

FIG. 2 illustrates a multilayer headbox 2 with a baffle-free headbox nozzle 6. Separating wedge 7 arranged in this baffle-free headbox nozzle 6 has a separating wedge protrusion Ü.7 in a range of 0.05 to 1.0, preferably 0.1 to 0.95, especially 0.2 to 0.90· the largest individual gap width s.10.1 of the two nozzle chambers 8.1, 8.2.

On the multilayer headboxes 2 illustrated in FIGS. 3 and 4 one preferably adjustable baffle 22.1 with a baffle immersion depth t.22.1 is located respectively on one outside wall 11.1 of headbox nozzle 6. Per definition, the respective baffle immersion depth t.22.1 is hereby the vertical immersion depth of respective baffle 22.1 into the associated fibrous stock suspension stream 5.10 (arrow). The adjustability of the respective baffle 22.1 is indicated by a respective double arrow. The respective baffle immersion depth t.22.1 into the adjacent fibrous stock suspension 5.10 (arrow) hereby assumes a value in a range of 1 to 30 mm, preferably in a range of 5 to 15 mm.

The two design forms in FIGS. 3 and 4 differ in that in the design form in FIG. 3 the lower lip protrusion L.11.2 of the lower outside wall 11.2 is greater than the separating wedge protrusion Ü.7 of separating wedge 7. In contrast, in the design form in FIG. 4, lower lip protrusion L.11.2 of lower outside wall 11.2 is smaller than separating wedge protrusion Ü.7 of separating wedge 7. In both design forms, respective separating wedge 7, as already described, again has a separating wedge protrusion Ü.7 in a range of 0.5 to ≦3.0, preferably 0.6 to ≦2.0, especially 0.7 to 1.5, · the largest individual gap width s.10.1 of the at least two nozzle chambers 8.1, 8.2.

Moreover, in all four illustrated design forms of multilayer headbox 2, the fibrous stock suspension streams 5.10 (arrow), 5.20 (arrow) emerging from the multilayer headbox 6 as a common fibrous stock suspension jet 20 can have different jet speeds v.5.10 (arrow), v.5.20 (arrow). Hereby the difference in jet speeds v.5.10 (arrow), v.5.20 (arrow) assumes a value in particular in the range of 10 to 60 m/min., preferably 15 to 25 m/min.

Figure 5:
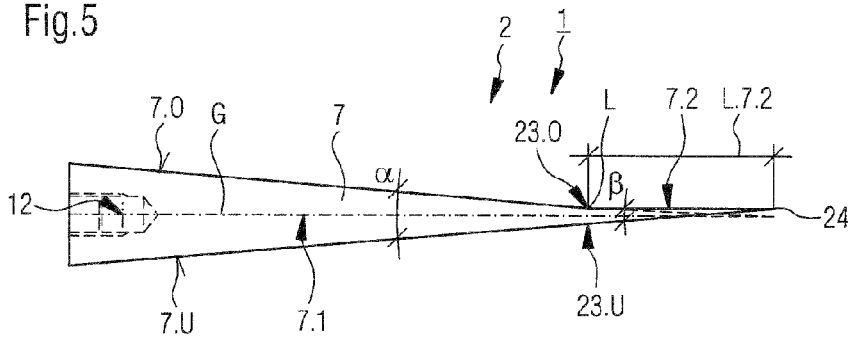
FIGS. 5 and 6 are schematic side views of two additional design forms of separating wedges in a multilayer headbox of an inventive sheet forming system.
Figure 6:
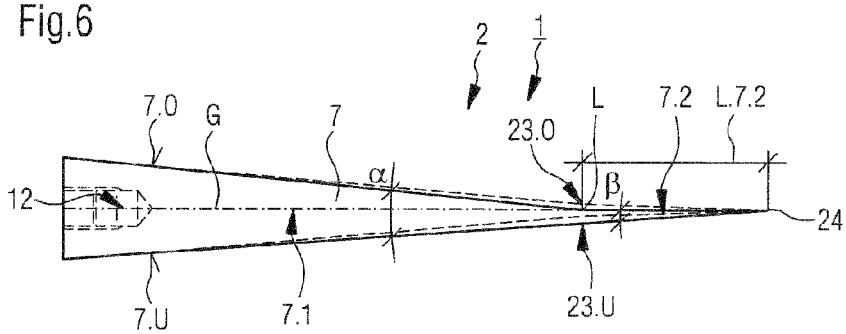

FIGS. 5 and 6 are schematically illustrated side views of two additional design forms of separating wedges 7 of a multilayer headbox 2 of an inventive sheet forming system 1.

On both separating wedges 7 a non-planar transition area 23.0 is provided on only one separating wedge surface 7.0 of separating wedge 7 between the two separating wedge areas 7.1, 7.2 of separating wedge 7. On the other separating wedge surface 7.0 of separating wedge 7 a planar transition area 23.0 is provided—therefore no geometric change between the two separating wedge areas 7.1, 7.2 of separating wedge 7 is provided.

In the example illustrated in FIG. 5 the upstream separating wedge starting area 7.1 of separating wedge 7 is aligned symmetrically with a straight line G extending through the upstream separating wedge retainer 12, whereby straight line G is defined as previously described. Since however the downstream separating wedge end area 7.2 of separating wedge 7 is aligned asymmetrically with straight line G extending through upstream separating wedge retainer 12 of separating wedge 7, separating wedge tip 24 of separating wedge 7 is not positioned on straight line G extending through upstream separating wedge retainer 12 of separating wedge 7.

In the design example illustrated in FIG. 6, upstream separating wedge starting area 7.1 of separating wedge 7 as well as downstream separating wedge end area 7.2 of separating wedge 7 are aligned asymmetrically with straight line G extending through the upstream separating wedge retainer 12 of separating wedge 7, whereby straight line G is defined as previously described. However, this design form provides that separating wedge tip 24 of separating wedge 7 is positioned on straight line G extending through upstream separating wedge retainer 12 of separating wedge 7. It could however also be positioned next to it.

In both design examples shown in FIGS. 5 and 6 the respective separating wedge starting angle $\alpha$ of upstream separating wedge starting area 7.1 has again an angular value in the range of 8 to 20°, preferably 10 to 15°. Respective separating wedge angle $\beta$ of downstream separation end area 7.2 again has an angular value in the range of 1.5 to 8°, preferably 2.5 to 4.5°, so that it is smaller than the separating wedge starting angle $\alpha$ of upstream separating wedge starting area 7.1. Downstream separating wedge end area 7.2 of the respective separating wedge 7 has a downstream separating wedge end length L7.2 in the range of 10 to 100 mm, preferably 15 to 75 mm, especially 25 to 50 mm.

In contrast to the design example of separating wedge 7 illustrated in FIG. 1, non-planar transition area 23.0 at separating wedge surface 7.0 between the two separating wedge areas 7.1, 7.2 of the individual separating wedge 7 illustrated in FIGS. 5 and 6 is geometrically angular. The transition progresses in transverse direction of separating wedge 7, in other words along a line L. The respective non-planar transition area could also be round with a corresponding radius.

Multilayer headbox 2 illustrated respectively in FIGS. 1 through 4 is particularly suitable for utilization in a machine for the production of a multilayer fibrous web 4, in particular a multilayer paper or cardboard web consisting of at least two fibrous stock suspensions 5.1, 5.2.

Lastly, a controlled stream, in particular a dilution water stream can be added to at least one fibrous stock suspension when producing a mixed stream with a mixing concentration. This allows for control of the fiber orientation cross profile, as well as the base weight profile of the multilayer fibrous web.

In summary it is emphasized that the invention creates a sheet forming system of the type described at the beginning, providing high grade layer integrity in height direction as well as good optical coverage quality of the outer fibrous stock suspension layers in a fibrous web produced by said system. In particular this is also made possible in the production of a fibrous web with a base weight in the range of 20 to 60 g/m$^2$ per fibrous stock suspension layer at a production speed in excess of 900 m/min.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION

1 Sheet forming system
2 Multilayer headbox
3 Gap former
4 Multilayer fibrous web
5.1 Fibrous stock suspension
5.10 Fibrous stock suspension stream (arrow)
5.2 Fibrous stock suspension
5.20 Fibrous stock suspension stream (arrow)
6 Headbox nozzle
7 Separating wedge
7.1 Upstream separating wedge starting area
7.2 Downstream separating wedge end area
7.0 Separating wedge surface
7.0 Separating wedge surface
8.1 Nozzle chamber
8.2 Nozzle chamber
9.1 Feed device
9.2 Feed device
10.1 Outlet gap
10.2 Outlet gap
11.1 Outside wall
11.2 Outside wall
12 Separating wedge retainer
13 First wire
14 Second wire
15 Forming roll
16 Circumferential area
17 Breast roll
18 Circumferential area
19 Stock inlet gap
20 Fibrous stock suspension free jet
21 Twin wire zone
22.1 Baffle
22.2 Baffle
23.O Transition area
23.U Transition area
24 Separating wedge tip
A.15 Open area
AG Total area
B Width (arrow)
B.15 Wrapped area
D.15 Diameter
G Straight line
L Line
L.11.2 Lower lip protrusion
L.20 Free jet length
L.7.2 Downstream separating wedge length
R.7.0 Radius
R.7.0 Radius
S Minimum rigidity
s.10.1 Gap width
s.10.2 Gap width
t.22.1 Baffle immersion depth
t.22.2 Baffle immersion depth
Ü.7 Separating wedge protrusion
v.5.10 Jet speed (arrow)
v.5.20 Jet speed (arrow)
$\alpha$ Separating wedge angle
$\beta$ Separating wedge angle
$\gamma$ Wrap angle

What is claimed is:

1. A sheet forming system for a machine for producing a multilayer fibrous web from at least two fibrous stock suspensions, the multilayer fibrous web being one of a multilayer paper web and a multilayer cardboard web, said sheet forming system comprising:

a multilayer headbox with a headbox nozzle which includes at least one separating wedge and at least two converging nozzle chambers extending over a width of the machine and separated from one another by said at least one separating wedge, said at least two converging nozzle chambers including a first nozzle chamber and a second nozzle chamber, said first nozzle chamber carrying a first fibrous stock suspension of the at least two fibrous stock suspensions in a form of a first fibrous stock suspension stream during an operation of said multilayer headbox, said second nozzle chamber carrying a second fibrous stock suspension of the at least two fibrous stock suspensions in a form of a second fibrous stock suspension stream during said operation of said multilayer headbox, said first nozzle chamber being equipped with a first upstream feed device and a first downstream outlet gap extending over said width and including a first gap width, said second nozzle chamber being equipped with a second upstream feed device and a second downstream outlet gap extending over said width and including a second gap width, said first and second nozzle chambers each being an outer nozzle chamber, said first nozzle chamber having a first outside wall on an outside of said first nozzle chamber, said second nozzle chamber having a second outside wall on an outside of said second nozzle chamber, said at least one separating wedge having a first separating wedge surface and a second separating wedge surface, said first separating wedge surface being in contact with said first fibrous stock suspension stream which is adjacent said first separating wedge surface during said operation of said multilayer headbox, said second separating wedge surface being in contact with said second fibrous stock suspension stream which is adjacent said second separating wedge surface during said operation of said multilayer headbox, said at least one separating wedge arranged in said headbox nozzle having a separating wedge protrusion in a range of 0.5 to 3.0 times a largest individual gap width of said at least two converging nozzle chambers, said at least one separating wedge including two separating wedge areas which are an upstream separating wedge starting area and a downstream separating wedge end area, said upstream separating wedge starting area having a separating wedge starting angle, said downstream separating wedge end area having a second separating wedge end angle, said separating wedge starting and end angles of said two separating wedge areas having different angular values, said separating wedge starting angle of said upstream separating wedge starting area having a greater angular value than said separating wedge end angle of said downstream separating wedge end area, at least one of said first separating wedge surface and said second separating wedge surface respectively including a non-planar transition area between said two separating wedge areas of said at least one separating wedge; and one gap former which is located immediately downstream from said multilayer headbox and which has a continuous revolving first wire and a continuous revolving second wire, said gap former further including a forming roll and a breast roll, said forming roll including a circumferential area and being an open forming roll, said breast roll including a circumferential area, said first wire running over said circumferential area of said forming roll, said second wire running over said circumferential area of said breast roll and then running onto said first wire in an area of the sheet forming system of said forming roll, thus forming a wedge shaped stock inlet gap which immediately receives said first and second fibrous stock suspension streams emerging from said headbox nozzle of said multilayer headbox as one common fibrous stock suspension free jet having a free jet length, said first and second wires with the at least two fibrous stock suspensions therebetween forming a twin wire zone at least in a plurality of sections, said common fibrous stock suspension free jet which includes at least said first and second fibrous stock suspension streams having a free jet length in a range of 100 mm to 500 mm, said open forming roll having a diameter in a range of 1,200 mm to 2,500 mm.

2. The sheet forming system according to claim 1, wherein said separating wedge protrusion is in a range of 0.1 to 2.0 times said largest individual gap width of said at least two converging nozzle chambers.

3. The sheet forming system according to claim 1, wherein said separating wedge protrusion is in a range of 0.2 to 1.5 times said largest individual gap width of said at least two converging nozzle chambers.

4. The sheet forming system according to claim 1, wherein said free jet length is in a range of 125 mm to 400 mm and said diameter is in a range of 1,300 mm to 2,400 mm.

5. The sheet forming system according to claim 1, wherein said free jet length is in a range of 150 mm to 300 mm and said diameter is in a range of 1,500 mm to 2,200 mm.

6. The sheet forming system according to claim 1, wherein said headbox nozzle is a baffle-free headbox nozzle, said at least one separating wedge located in said baffle-free headbox nozzle having a separating wedge protrusion in a range of 0.05 to 1.0 times said largest individual gap width of said at least two converging nozzle chambers.

7. The sheet forming system according to claim 1, wherein said headbox nozzle is a baffle-free headbox nozzle, said at least one separating wedge located in said baffle-free headbox nozzle having a separating wedge protrusion in a range of 0.1 to 0.95 times said largest individual gap width of said at least two converging nozzle chambers.

8. The sheet forming system according to claim 1, wherein said headbox nozzle is a baffle-free headbox nozzle, said at least one separating wedge located in said baffle-free headbox nozzle having a separating wedge protrusion in a range of 0.2 to 0.90 times said largest individual gap width of said at least two converging nozzle chambers.

9. The sheet forming system according to claim 1, further including, located on at least one of said first outside wall and said second outside wall of said headbox nozzle, one adjustable baffle with a baffle immersion depth, said at least one separating wedge located in said headbox nozzle having a separating wedge protrusion in a range of 0.5 to ≦3.0 times said largest individual gap width of said at least two converging nozzle chambers.

10. The sheet forming system according to claim 1, further including, located on at least one of said first outside wall and said second outside wall of said headbox nozzle, one adjustable baffle with a baffle immersion depth, said at least one separating wedge located in said headbox nozzle having a separating wedge protrusion in a range of 0.6 to ≦2.0 times said largest individual gap width of said at least two converging nozzle chambers.

11. The sheet forming system according to claim 1, further including, located on at least one of said first outside wall and said second outside wall of said headbox nozzle, one adjustable baffle with a baffle immersion depth, said at least one separating wedge located in said headbox nozzle having a separating wedge protrusion in a range of 0.7 to 1.5 times said largest individual gap width of said at least two converging nozzle chambers.

12. The sheet forming system according to claim 1, wherein said first separating wedge surface includes thereon a first said non-planar transition area between said two separating wedge areas of said at least one separating wedge, said second separating wedge surface including thereon a second said non-planar transition area between said two separating wedge areas of said at least one separating wedge.

13. The sheet forming system according to claim 1, wherein said at least one separating wedge includes an upstream separating wedge retainer, at least said upstream separating wedge starting area of said at least one separating wedge being aligned symmetrically with one straight line extending through said upstream separating wedge retainer.

14. The sheet forming system according to claim 13, wherein said at least one separating wedge includes an upstream separating wedge retainer and a separating wedge tip, said upstream separating wedge starting area of said at least one separating wedge and said downstream separating wedge end area of said at least one separating wedge being aligned symmetrically to said straight line extending through said upstream separating wedge retainer of said at least one separating wedge so that said separating wedge tip of said at least one separating wedge is then positioned on said straight line extending through said upstream separating wedge retainer of said at least one separating wedge.

15. The sheet forming system according to claim 1, wherein said first separating wedge surface includes thereon said non-planar transition area between said two separating wedge areas of said at least one separating wedge, said second separating wedge surface including thereon a planar transition area between said two separating wedge areas of said at least one separating wedge.

16. The sheet forming system according to claim 15, wherein said at least one separating wedge includes an upstream separating wedge retainer, at least said upstream separating wedge starting area of said at least one separating wedge being aligned symmetrically with one straight line extending through said upstream separating wedge retainer of said at least one separating wedge.

17. The sheet forming system according to claim 15, wherein said at least one separating wedge includes an upstream separating wedge retainer, said upstream separating wedge starting area of said at least one separating wedge and said downstream separating wedge end area of said at least one separating wedge being aligned asymmetrically to a straight line extending through said upstream separating wedge retainer of said at least one separating wedge.

18. The sheet forming system according to claim 1, wherein said separating wedge starting angle of said upstream separating wedge starting area of said at least one separating wedge has an angular value in a range of 8° to 20°, and said separating wedge end angle of said downstream separating wedge end area of said at least one separating wedge has an angular value in a range of 1.5° to 8°.

19. The sheet forming system according to claim 1, wherein said separating wedge starting angle of said upstream separating wedge starting area of said at least one separating wedge has an angular value in a range of 10° to 15°, and said separating wedge end angle of said downstream separating wedge end area of said at least one separating wedge has an angular value in a range of 2.5° to 4.5°.

20. The sheet forming system according to claim 1, wherein said downstream separating wedge end area of said at least one separating wedge has a downstream separating wedge end length in a range of 10 mm to 100 mm.

21. The sheet forming system according to claim 1, wherein said downstream separating wedge end area of said at least one separating wedge has a downstream separating wedge end length in a range of 15 mm to 75 mm.

22. The sheet forming system according to claim 1, wherein said downstream separating wedge end area of said at least one separating wedge has a downstream separating wedge end length in a range of 25 mm to 50 mm.

23. The sheet forming system according to claim 1, wherein said downstream separating wedge end area of said at least one separating wedge protrudes beyond said first and second downstream outlet gaps of said headbox nozzle in a range of 10 mm to 25 mm.

24. The sheet forming system according to claim 1, wherein said open forming roll has an open area in a range of 60% to 99% of a total area of said open forming roll.

25. The sheet forming system according to claim 1, wherein said open forming roll has an open area in a range of 70% to 98% of a total area of said open forming roll.

26. The sheet forming system according to claim 1, wherein said open forming roll has an open area in a range of 80% to 96% of a total area of said open forming roll.

27. The sheet forming system according to claim 1, wherein said open forming roll has an area around which both said first and second wires, with the at least two fibrous stock suspensions therebetween, wrap with an angle of wrap in a range of 15° to 260°.

28. The sheet forming system according to claim 1, wherein said open forming roll has an area around which both said first and second wires, with the at least two fibrous stock suspensions therebetween, wrap with an angle of wrap in a range of 30° to 230°.

29. The sheet forming system according to claim 1, wherein said open forming roll has an area around which both said first and second wires, with the at least two fibrous stock suspensions therebetween, wrap with an angle of wrap in a range of 50° to 180°.

30. A machine to produce a multilayer fibrous web from at least two fibrous stock suspensions, the multilayer fibrous web being one of a multilayer paper web and a multilayer cardboard web, said machine comprising:

at least one sheet forming system including:

a multilayer headbox with a headbox nozzle which includes at least one separating wedge and at least two converging nozzle chambers extending over a width of the machine and separated from one another by said at least one separating wedge, said at least two converging nozzle chambers including a first nozzle chamber and a second nozzle chamber, said first nozzle chamber carrying a first fibrous stock suspension of the at least two fibrous stock suspensions in a form of a first fibrous stock suspension stream during an operation of said multilayer headbox, said second nozzle chamber carrying a second fibrous stock suspension of the at least two fibrous stock suspensions in a form of a second fibrous stock suspension stream during said operation of said multilayer headbox, said first nozzle chamber being equipped with a first upstream feed device and a first downstream outlet gap extending over said width and including a first gap width, said second nozzle chamber being equipped with a second upstream feed device and a second downstream outlet gap extending over said width and including a second gap width, said first and second nozzle chambers each being an outer nozzle chamber, said first nozzle chamber having a first outside wall on an outside of said first nozzle chamber, said second nozzle chamber having a second outside wall on an outside of said second nozzle chamber, said at least one separating wedge having a first separating wedge surface and a second separating wedge surface, said first separating wedge surface being in contact with said first fibrous stock suspension stream which is adjacent said first separating wedge surface during said operation of said multilayer headbox, said second separating wedge surface being in contact with said second fibrous stock suspension stream which is adjacent said second separating wedge surface during said operation of said multilayer headbox, said at least one separating wedge arranged in said headbox nozzle having a separating wedge protrusion in a range of 0.5 to 3.0 times a largest individual gap width of said at least two converging nozzle chambers, said at least one separating wedge including two separating wedge areas which are an upstream separating wedge starting area and a downstream separating wedge end area, said upstream separating wedge starting area having a separating wedge starting angle, said downstream separating wedge end area having a second separating wedge end angle, said separating wedge starting and end angles of said two separating wedge areas having different angular values, said separating wedge starting angle of said upstream separating wedge starting area having a greater angular value than said separating wedge end angle of said downstream separating wedge end area, at least one of said first separating wedge surface and said second separating wedge surface respectively including a non-planar transition area between said two separating wedge areas of said at least one separating wedge; and one gap former which is located immediately downstream from said multilayer headbox and which has a continuous revolving first wire and a continuous revolving second wire, said gap former further including a forming roll and a breast roll, said forming roll including a circumferential area and being an open forming roll, said breast roll including a circumferential area, said first wire running over said circumferential area of said forming roll, said second wire running over said circumferential area of said breast roll and then running onto said first wire in an area of said sheet forming system of said forming roll, thus forming a wedge shaped stock inlet gap which immediately receives said first and second fibrous stock suspension streams emerging from said headbox nozzle of said multilayer headbox as one common fibrous stock suspension free jet having a free jet length, said first and second wires with the at least two fibrous stock suspensions therebetween forming a twin wire zone at least in a plurality of sections, said common fibrous stock suspension free jet which includes at least said first and second fibrous stock suspension streams having a free jet length in a range of 100 mm to 500 mm, said open forming roll having a diameter in a range of 1,200 mm to 2,500 mm.

* * * * *

UNITED STATES PATENT AND TRADEMARK OFFICE

CERTIFICATE OF CORRECTION

PATENT NO. : 8,308,909 B2
APPLICATION NO. : 13/161086
DATED : November 13, 2012
INVENTOR(S) : Markus Haussler et al.

It is certified that error appears in the above-identified patent and that said Letters Patent is hereby corrected as shown below:

IN THE SPECIFICATION

COLUMN 8

At line 18, please delete "7.0, 7.0", and substitute therefore --7.O, 7.U--.

COLUMN 9

At line 50, please delete "23.0, 23.0", and substitute therefore --23.O, 23.U--;
At line 51, please delete "7.0, 7.0", and substitute therefore --7.O, 7.U--; and
At line 52, please delete "R7.0, R7.0", and substitute therefore --R7.O, R7.U--.

COLUMN 10

At line 60, please delete "7.0", and substitute therefore --7.U--; and
At line 60, please delete "23.0", and substitute therefore --23.U--.

COLUMN 12

In the Component Identification, Line 20, please delete the second occurrence of "7.0 Separating wedge surface", and substitute therefore --7.U Separating wedge surface--; and
In the Component Identification, Line 55, please delete the second occurrence of "R.7.0 Radius", and substitute therefore --R.7.U Radius--.

Signed and Sealed this
Twenty-second Day of October, 2013

Teresa Stanek Rea
*Deputy Director of the United States Patent and Trademark Office*